US008474365B2

(12) United States Patent
Kaufmann et al.

(10) Patent No.: US 8,474,365 B2
(45) Date of Patent: Jul. 2, 2013

(54) DIAPHRAGM PUMP

(75) Inventors: Stephan Kaufmann, Gunzwil (CH); Christian Kissling, Fulenbach (CH); Michael Bucher, Schötz (CH)

(73) Assignee: KNF Flodos AG, Sursee (CH)

( * ) Notice: Subject to any disclaimer, the term of this patent is extended or adjusted under 35 U.S.C. 154(b) by 728 days.

(21) Appl. No.: 12/664,951

(22) PCT Filed: Mar. 14, 2008

(86) PCT No.: PCT/EP2008/002044

§ 371 (c)(1),
(2), (4) Date: Dec. 16, 2009

(87) PCT Pub. No.: WO2008/154971

PCT Pub. Date: Dec. 24, 2008

(65) Prior Publication Data

US 2010/0183462 A1 Jul. 22, 2010

(30) Foreign Application Priority Data

Jun. 20, 2007 (DE) ..... 10 2007 028 351

(51) Int. Cl.
*F01B 1/00* (2006.01)
*F16J 1/14* (2006.01)

(52) U.S. Cl.
USPC ..... 92/72; 92/84

(58) Field of Classification Search
USPC ..... 92/72, 84, 129, 137; 417/413.1
See application file for complete search history.

(56) References Cited

U.S. PATENT DOCUMENTS

| | | | | |
|---|---|---|---|---|
| 4,097,203 | A * | 6/1978 | Selwood et al. | 417/480 |
| 5,039,283 | A * | 8/1991 | Mergenthaler et al. | 92/129 |
| 5,044,891 | A | 9/1991 | Ozawa | |
| 5,437,218 | A | 8/1995 | Papin | |
| 5,839,349 | A * | 11/1998 | Volz | 92/84 |
| 7,481,629 | B2 * | 1/2009 | Winter | 92/72 |

FOREIGN PATENT DOCUMENTS

| | | |
|---|---|---|
| DE | 4433068 | 3/1996 |
| DE | 69616648 | 8/2002 |
| EP | 0207212 | 1/1987 |
| GB | 1548888 | 7/1979 |
| WO | 9218769 | 10/1992 |

* cited by examiner

*Primary Examiner* — Michael Leslie
(74) *Attorney, Agent, or Firm* — Volpe and Koenig, P.C.

(57) ABSTRACT

A diaphragm pump (1) has at least two pump heads (3) arranged around a central eccentric pump drive (2), the diaphragms (4) being drivingly connected to the eccentric pump drive (2) via connecting rods (5). The eccentric pump drive (2) has a connecting rod ring (6) to which the ends (9) of the connecting rods are connected via elastic intermediates (10).

14 Claims, 3 Drawing Sheets

DIAPHRAGM PUMP

BACKGROUND

The invention relates to a diaphragm pump with at least two pump heads arranged around a central eccentric pump drive, with the diaphragms being drivingly connected via connecting rods to the eccentric pump drive.

Such diaphragm pumps are already known. Here, all diaphragms of the pump heads are moved back and forth via an eccentric and one connecting rod each. All diaphragm centers are positioned in a common plane, so that such pumps have a compact design. The interior ends of the connecting rods are connected in an articulated fashion to the eccentric drive, with in the region of the joint a pivotal motion of the connecting rods occurs. This joint is subject to compressive and tensile stress as well as bending stress by the pivotal motion of the connecting rods. Consequently, increased wear-related operating noise can develop and this also negatively affects the overall life of the device.

SUMMARY

The object of the present invention is to provide a diaphragm pump of the type mentioned at the outset, which can be produced in a more cost-effective manner, has compact dimensions and fewer components, produces low noise emissions even after an extended period of operation, and which shows a high operational safety.

In order to attain this objective it is suggested that the eccentric pump drive comprises a connecting rod ring, by which the ends of the connecting rods are connected via elastic intermediate elements. By this elastic connection between the connecting rod and the eccentric drive, on the one side, the necessary articulating function is given in a simple fashion and additionally a transfer of body oscillations between the drive and the connecting rods is dampened and thus, on the one side, a distribution of noise via the diaphragm and the pump heads, however also via the eccentric, the shaft, the bearing, and the housing on the other side, is reduced.

The elastic intermediate element practically forms an elastomer joint and is permanently free of play and this way also contributes to the pump being maintenance free and developing no disturbing noise, even after an extended period of operation.

The further developments of particular importance are realized in that the spring deflection of the elastic intermediate elements is comparatively short in the axial direction of the connecting rods and/or in the radial direction in reference to the connecting rod ring and that in the radial direction of the connecting rods and/or tangentially in reference to the connecting rod ring it is sized corresponding to the lateral deflection occurring by the oscillation movement of the connecting rod.

By the low elasticity of the intermediate elements in the axial direction of the connecting rod, the eccentric lift is precisely transferred to the connecting rod, in spite of the forces impinging the connecting rod. Due to the high stiffness of the intermediate elements in the axial direction, the diaphragm pump is also suitable for high pump pressures.

The spring stiffness of the intermediate elements in the axial direction of the connecting rods is therefore high and accordingly the deflection is short. The axial extension of the intermediate elements may be kept small for a high spring stiffness of the intermediate elements in the axial direction of the connecting rods.

However, the spring stiffness in the radial direction of the connecting rod and/or in the tangential direction of the connecting rod ring is comparatively low and thus the deflection and the elastic resilience is correspondingly high.

In this way, the radial diaphragm forces developing due to the tilting motion of the connecting rod are kept low and thus the diaphragms, otherwise highly stressed by their pumping task, are only impinged with little radial diaphragm forces.

An advantageous embodiment of the invention provides for the connecting rod ring comprising recesses at the exterior, each of which is open at its edges, in order to at least partially accept the end of the connecting rod connected to an intermediate element.

This allows a particularly safe and durable connection between the connecting rod ring and the connecting rods and additionally it predetermines the precise position of the respective connection site. Here, on the one side the recesses and on the other side the ends of the connecting rods are sized such that sufficient clear space is provided therebetween for the elastic intermediate element and the above-described joint function.

Here, the intermediate element forms an intermediate layer between the wall of the recess and the end region of the connecting rod.

It is particularly beneficial when elastomeric intermediate elements are connected by way of vulcanization on the one side to the respective end of the connecting rod and on the other side to the connecting rod ring. This results in an elastic and durable connection.

In existing recesses of the connecting rod ring, e.g., the vulcanized connection is made to the interior wall of the recesses and the end section of the connecting rod. In the simplest case, primarily in small pumps, the connecting rod ring and the connecting rod may be directly connected to a vulcanized elastomer.

In both exemplary embodiments the connecting rod ring and the connecting rod elastically connected thereto form a structural unit.

According to a preferred embodiment of the invention the diaphragm pump comprises four pump heads arranged around the central eccentric pump drive. Here, the connecting rods of all pump heads are arranged in a common plane. In this way, the diaphragm centers are all located on the same plane such that the pump is compact and can be produced with fewer components in a cost-effective fashion.

BRIEF DESCRIPTION OF THE DRAWINGS

Additional embodiments of the invention are described in the other dependent claims.

In the following the invention is explained in greater detail using the drawings. Shown in a partially schematic illustration are.

DETAILED DESCRIPTION OF THE PREFERRED EMBODIMENTS

Figure 1:
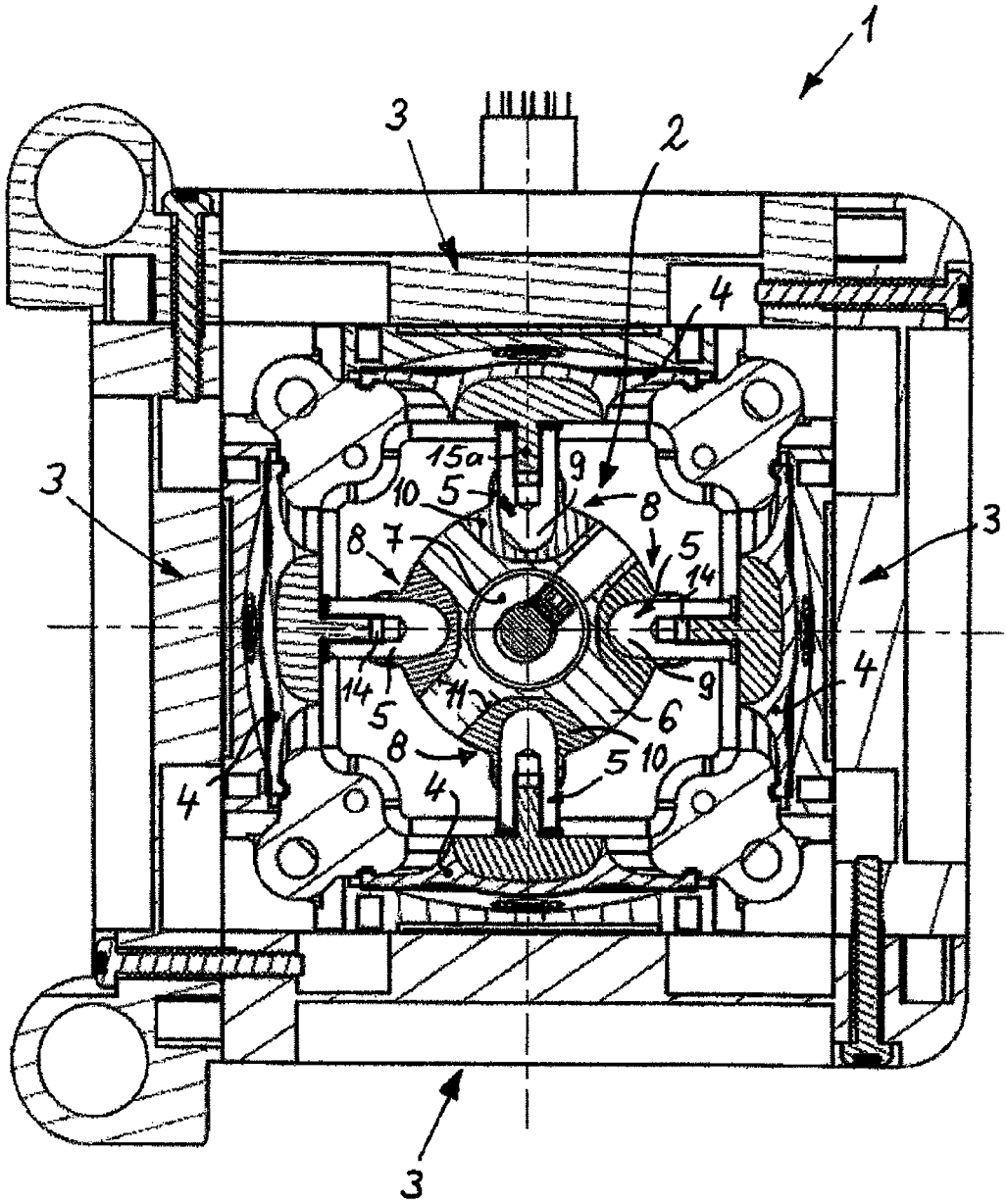
FIG. 1 a diaphragm pump with four pump heads and a central eccentric pump drive in a cross-sectional view, FIG. 2 a slightly schematic view of a four-headed diaphragm pump, FIG. 3 a view of a connecting rod ring with recesses at the exterior that are open at their edges for intermediates and ends of connecting rods and/or connecting parts, FIG. 4 an enlarged view of a detail in the area of a recess in the connecting rod ring for accepting an intermediate and an end of a connecting rod, and FIG. 5 a schematic view of a four-headed diaphragm pump with the wiring of the suction lines and the pressure lines.

A diaphragm pump 1 shown in FIG. 1 is depicted in a cross-section and comprises four pump heads 3 arranged around a central eccentric pump drive 2. The diaphragms 4 are each drivingly connected via connecting rods 5 to the eccentric pump drive 2.

The eccentric pump drive 2 comprises a connecting rod ring 6, in which a circumferential eccentric 7 is arranged. The connecting rod ring 6 can be preferably embodied circularly at the outside or show an exterior shape deviating therefrom. The design of the diaphragm pump is also easily discernible in the schematic illustration according to FIG. 2.

When the eccentric 7 is rotated its eccentric motion is transferred to the connecting rod ring 6 such that the connecting rod 5 can perform a lifting and pendulum motion. In order to transfer said drive motion from the connecting rod ring 6 to the connecting rod 5 joints 8 are provided, which are practically embodied as elastomeric joints. For this purpose, ends 9 of the connecting rods are connected via elastic intermediate elements 10 to the connecting rod ring 6.

This elastic intermediate element 10, being a link 8, must fulfill different requirements with regard to the force transferred from the eccentric pump drive to the connecting rod 5 and/or the diaphragms 4. On the one side, shearing and/or tensile forces must be transferred, on the other hand, however, a lateral pendulum motion must be allowed with as little resistance as possible. The shearing and tensile forces occurring shall practically be transferred directly and without any play. The elastic intermediate shall accordingly have a high spring resistance in said direction of stress. This can be achieved by the axial extension of the intermediates 10 being comparatively small. However, in order to achieve a potential lateral deflection of the connecting rod showing as little resistance as possible the radial extension of the elastic intermediate, i.e. perpendicular in reference to the longitudinal extension of the connecting rod 5, is comparatively large.

Figure 2:
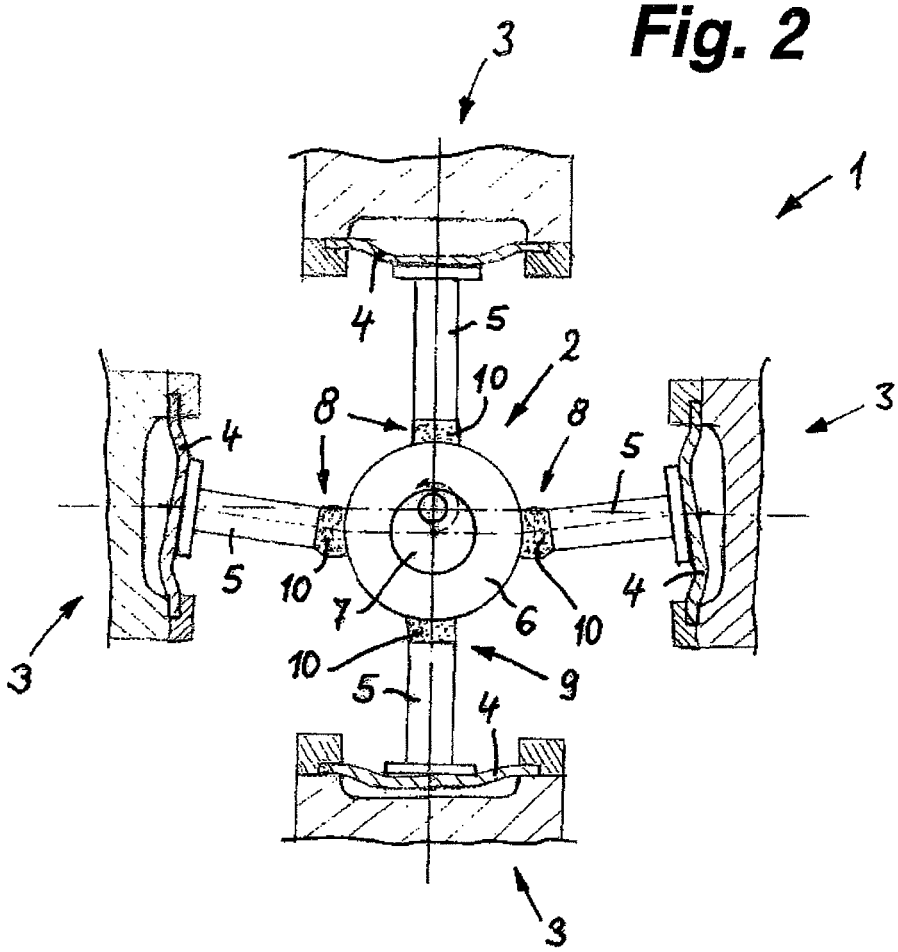

In the exemplary embodiment shown in FIG. 2, the radial extension of the intermediate elements 10 is equivalent to the adjacent connecting rod 5. If applicable, the intermediate elements 10 may also show a smaller diameter or circular constrictions in order to improve lateral mobility.

The connecting rod 5 can be connected at the outside of the connecting rod ring 6 in a simple fashion by way of vulcanization. Here, the material connected by way of vulcanization at both sides forms the intermediate elements 10. Another option to produce an elastic connection between the connecting rods and the connecting rod rings is the use of silicon adhesives or a formed silicon part.

The elastic intermediate elements 10 can therefore be made from a vulcanized elastomer or from a moldable elastomer, such as silicon for example. Thermoplastic elastomers can also be used for the intermediate elements 10.

In FIG. 1, the connecting rod ring 6 comprises at its exterior recesses 11, open at their edges, each serving for an at least partial acceptance of an end 9 of the connecting rod connected to an intermediate element 10. Here, the intermediate element 10 forms an intermediate layer between the wall 12 of the recess and the end 9 of the connecting rod. Here, it is clearly discernible that the different requirements with regard to the elastic resilience in the axial direction and with regard to the swiveling motion of the connecting rods 5 are achieved in that the axial distance of the end 9 of the connecting rod from the interior wall 12 is comparatively small and the radial distance of the end of the connecting rod from the interior wall is relatively large. For this purpose, in the exemplary embodiment shown in FIG. 1, the recesses 11 are embodied approximately trough-shaped.

Figure 3:
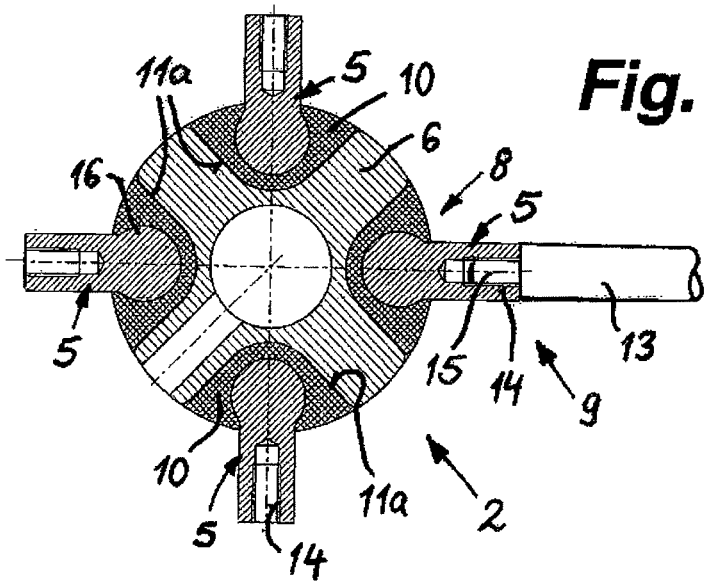

In the exemplary embodiment shown in FIG. 3, in the connecting sections of the connecting rod 5 the connecting rod ring 6 also comprises recesses 11*a*, open at their edges, which show expansions at their exterior section. In these embodiments, too, high compressive forces can be transferred without resulting in disturbing deflections of the ends of the connecting rods. On the other side, by the expansions of the recesses in the exterior region the necessary pendulum motion of the ends of the connecting rods can occur with little resistance.

Even when the recesses show an approximately semi-circular cross-section and the formations 16, as shown in FIG. 3, for example a helical cross-section and furthermore said formations 16 each are located completely or largely completely inside the recess expansions are formed in the exterior section, which facilitate the pendulum motion of the ends of the connecting rods.

In the exemplary embodiment shown in FIG. 3, the exterior end 9 of the connecting rod at the end facing the diaphragm is not directly connected to the diaphragm but here additionally a connecting rod—extension 13 is provided, with the connecting rod—extension 13 comprising a threaded bolt 15 to be screwed into a threaded bore 14 of the connecting rod 5.

In FIG. 1 it is discernible that the diaphragm 4 comprises a mushroom-shaped head connected to the elastic diaphragm part, particularly made from metal, comprising one threaded bolt 15*a* each to be screwed into the threaded bore 14 of the connecting rod or into an exterior threaded bore of the extension 13 of the connecting rod.

In the exemplary embodiment according to FIG. 1, the ends 9 of the connecting rods are embedded in a rubber-elastic material which is located in the recesses 11. Here, too, the rubber-elastic material forms the intermediate elements 10, which are connected by way of vulcanization to the recesses 10 and to the ends 9 of the connecting rods. Silicon adhesives may be used, for example as the rubber-elastic material.

The connecting rod ring 6 is preferably embodied as a circular disk, with the recesses 11, 11*a*, opening radially outward at their edges, being embodied groove-shaped. In the lateral direction said recesses 11, 11*a* may extend over a partial section of the thickness of the disk or over the entire thickness of the disk such that they are also open towards the flat sides of the connecting rod ring. The formations 16 may represent cylindrical cross pins of a length equivalent to the thickness of the disk or less so that a respectively large support area is provided.

If applicable, the formations 16 may also be embodied as spherical heads, into which then perhaps preferably spherical recesses 11*a* are inserted by adhesion or by vulcanization. The intermediate elements 10 are embodied as an elastic intermediate layer between the spherical head and the interior wall of each of the recesses 11*a*.

Furthermore, there is the option to insert the intermediate elements 10 into the recesses 11*a* by way of adhesion or vulcanization and to provide an insertion opening with an undercut such that the spherical heads or similar formations must be pressed in and are then held in a form-fitting fashion.

In the exemplary embodiment according to FIG. 3, the recesses 11*a* in the connecting rod ring 6 may be embodied approximately semi-spherically or semi-spherically disk-shaped and the formations 16 may be embodied as spherical heads, as round disks, or as perpendicularly arranged cylinders, with the recesses 11*a* and the formations 16 being sized such that the formation fits into the recess, preferably in its entirety.

In the exemplary embodiment according to FIG. 1, the ends 9 of the connecting rod are rounded, however, they show no cross-sectional expansions. However, they engage the elastic intermediate elements 10 relatively deeply so that a secure fastening is given.

Figure 4:
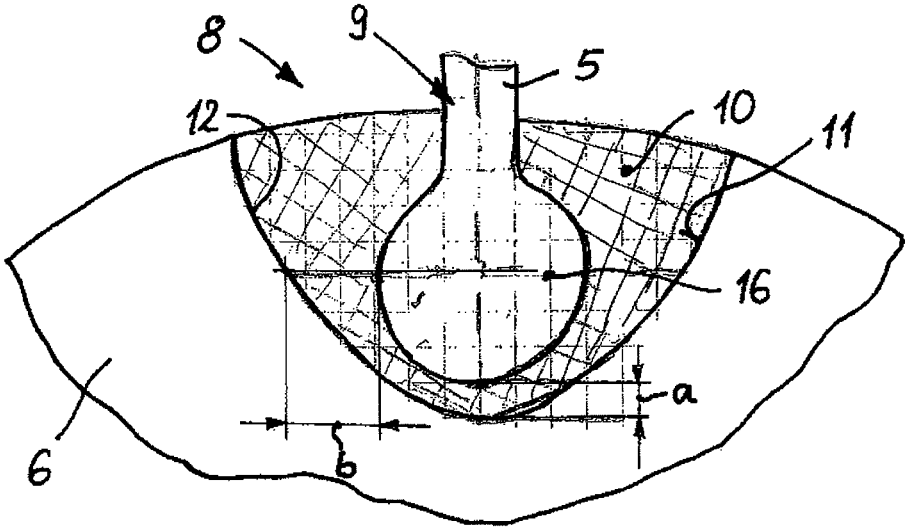

Particularly in the embodiment according to FIG. 4, it is clearly discernible that the axial distance a is considerably shorter than the lateral distance, particularly the radial distance b, with said lateral distance to the exterior end of the connecting rod ring considerably increasing.

The thin material layer gives considerably less under pressure impinged in the axial direction than a material layer having a considerably greater thickness. This way the axial shearing forces are transferred largely without deflection, while the swivel motions of the connecting rods are faced with only little resistance.

According to FIG. 4, the recesses 11 in the connecting rod ring 6 have a shape deviating from a partially circular shape in the cross-section with simultaneously showing cylindrical or spherical or spherical disk-shaped formations 16.

The axial distance a of the end 9 of the connecting rod from the radial distance b of the end of the connecting rod each from the interior wall 12 of the recess can have a ratio from approximately 1:1 to approximately 1:5, for example.

Even at a ratio of layer thicknesses of 1:1 the swivel motion is still confronted by a lower resistance than the axial impingement with shearing forces, because in spite of identical layer thicknesses different deflection paths also result from the different motions.

Figure 5:
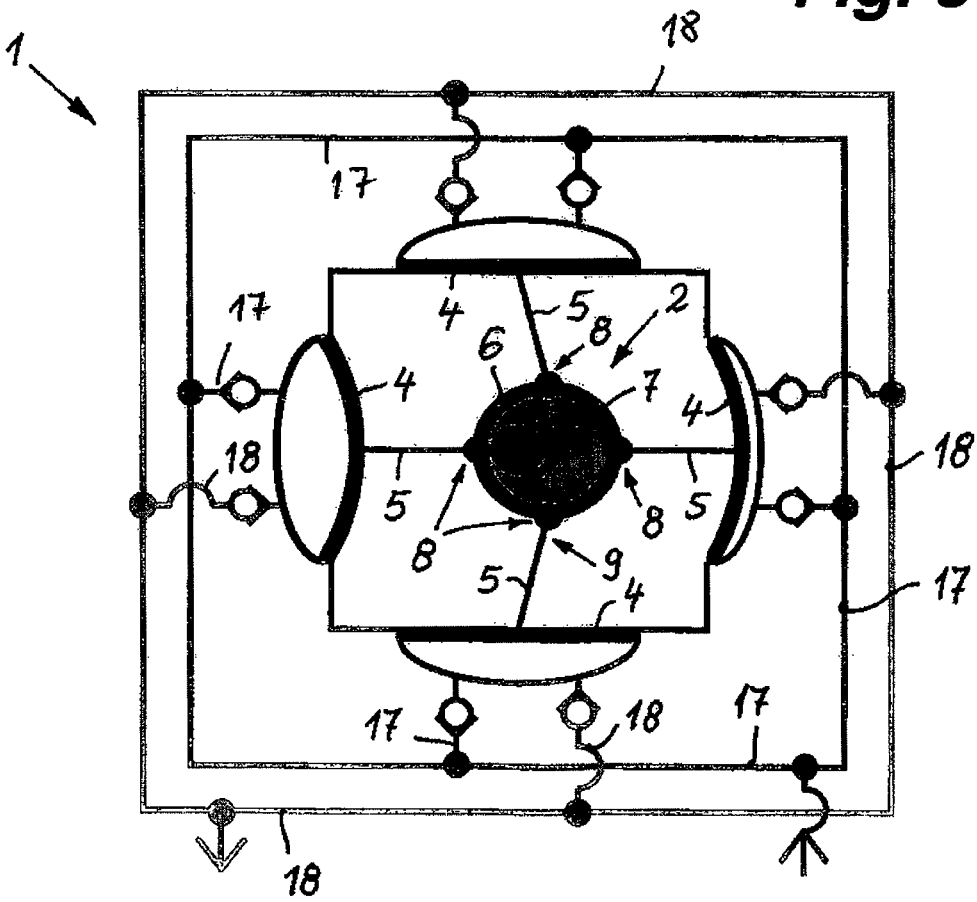

In FIG. 5, it is also shown schematically that the suction lines 17, on the one side, and the pressure lines 18 of the pump heads 3, on the other side, are connected to each other for liquids to flow. Using several operating elements (diaphragms 4) switched parallel by way of hydraulics but operating in a temporarily off-set sequence, both at the suction side as well as the pressure side a very low-pulsing conveyance is achieved. By the use of several pump heads 3, for example four pump heads, the drive moment is subject to small oscillations only, so that comparatively small drive motors can be used for the eccentric pump drive 2.

The invention claimed is:

1. A diaphragm pump (1) comprising at least two pump heads (3) arranged around a central eccentric pump drive (2), wherein the at least two pump heads are (4) drivingly connected by connecting rods (5) to the eccentric pump drive (2), the eccentric pump drive (2) comprises a connecting rod ring (6), that is connected to ends (9) of the connecting rods via respective elastic intermediate elements (10), the connecting rod ring at an exterior thereof includes recesses, each open at the edges thereof, for at least partially accepting the ends of the connecting rods connected to the elastic intermediate elements, and the elastic intermediate element in each case forms an intermediate layer between recess walls of the recesses and the connecting rod ends.

2. A diaphragm pump according to claim 1, wherein a deflection of the elastic intermediate elements (10) is smaller in comparison to an elastic deflection transverse to an axial direction of the connecting rods (5), and in an approximately radial direction of the connecting rods (5) a lateral deflection occurring is sized according to a pendulum motion of the connecting rods (5).

3. A diaphragm pump according to claim 1, wherein the intermediate elements (10) are connected to the respective ends (9) of the connecting rods and the connecting rod ring (6) by vulcanization.

4. A diaphragm pump according to claim 1, wherein the ends (9) of the connecting rods comprise a cross-sectional expansion, which is at least partially located inside the respective one of the elastic intermediate elements (10).

5. A diaphragm pump according to claim 4, wherein the cross-sectional expansion of the ends (9) of the connecting rods is formed by an approximately spherical or spherical-disk shaped formation or by a cylindrical cross pin.

6. A diaphragm pump according to claim 1, wherein an axial distance of the ends (9) of the connecting rods from an interior wall of the recess (11, 11*a*) is small and a radial distance of the ends (9) of the connecting rods from the interior wall of the recess is large.

7. A diaphragm pump according to claim 1, wherein the recesses (11, 11*a*) in the connecting rod ring (6) for spherical or spherical-disk shaped formations at the ends (9) of the connecting rods have a form deviating in cross-section from a partially circular shape.

8. A diaphragm pump according to claim 1, wherein the recesses (11, 11*a*) in the connecting rod ring (6) are embodied approximately semi-spherical or semi-spherical disk shaped, or cylindrical and the formations at the ends (9) of the connecting rods are embodied approximately spherical or spherical-disk shaped or cylindrical and the recesses (11, 11*a*) and the formations are sized such that the formations fit into the recess (11, 11*a*) in their entirety.

9. A diaphragm pump according to claim 1, wherein a ratio of an axial distance (a) of the end (9) of the connecting rod to a radial distance (b) of the end (9) of the connecting rod, each from an interior wall of the recess (11, 11*a*), ranges from approximately 1:1 to approximately 1:5.

10. A diaphragm pump according to claim 1, wherein the end (9) of the connecting rod facing the drive comprises a connecting part to connect to the intermediate element (10) and the connecting part has a coupling point for connecting to the connecting rod (5).

11. A diaphragm pump according to claim 1, wherein suction lines (17), on the one side, and pressure lines (18) of the pump heads (3), on the other side, are connected to each other for liquids to flow.

12. A diaphragm pump according to claim 1, wherein the pump comprises four pump heads (3) arranged around the central eccentric pump drive (2).

13. A diaphragm pump according to claim 1, wherein the connecting rods (5) of all pump heads (3) are arranged in a common plane.

14. A diaphragm pump according to claim 1, wherein the elastic intermediate elements (10) are formed from a vulcanized elastomer, a thermoplastic elastomer or a pourable elastomer.

* * * * *